United States Patent [19]

Hsieh

[11] Patent Number: 5,005,247

[45] Date of Patent: Apr. 9, 1991

[54] HYGIENIC TOOTHBRUSH

[76] Inventor: Kin-Shue Hsieh, 4F., No. 30, Chung Hsin North St., San Chung City, Taipei, Taiwan

[21] Appl. No.: 501,458

[22] Filed: Mar. 29, 1990

[51] Int. Cl.[5] ..... A46B 15/00

[52] U.S. Cl. ..... 15/167.1; 15/246

[58] Field of Search ..... 15/167.1, 246; 206/361, 206/362.2, 362.3

[56] References Cited

U.S. PATENT DOCUMENTS

| | | | |
|---|---|---|---|
| 1,342,521 | 6/1920 | Yanagihara | 15/167.1 |
| 1,619,946 | 3/1927 | Magee | 15/167.1 |
| 1,904,609 | 4/1933 | Bleadon | 15/167.1 |
| 2,121,373 | 6/1938 | Turner | 15/167.1 |
| 2,233,831 | 3/1941 | Burke | 15/167.1 |

*Primary Examiner*—Philip R. Coe
*Assistant Examiner*—P. Brinson
*Attorney, Agent, or Firm*—Varndell Legal Group

[57] ABSTRACT

A hygienic toothbrush, which has a protective strip extending over the bundles of bristles of the brush head thereof from a hole in the brush handle. The protective strip is broken off at its connecting end in the hole in the brush handle when it is in use, such that one can easily identify if a toothbrush has been used.

5 Claims, 1 Drawing Sheet

HYGIENIC TOOTHBRUSH

BACKGROUND AND SUMMARY OF THE INVENTION

The present invention is related to toothbrushes and more particularly to a hygienic toothbrush which has a brush head protective strip which is broken off when a toothbrush is in use so that one can easily identify if a toothbrush has been used.

Toothbrush is a brush designed for cleaning the teeth. In hotel, disposable toothbrushes are commonly provided in each room for use. Regular disposable toothbrushes are individually packed with a plastic bag. After use, a disposable toothbrush must be thrown away. If used toothbrushes are retreated for further use, it is very dangerous to contaminate with disease-producing matters. The present invention is to help people identify if a toothbrush has been used, so as to eliminate any possible infection through a toothbrush.

The present invention is to provide a hygienic toothbrush which has a protective strip extending over the bundles of bristles of the brush head thereof from a hole in the brush handle. The protective strip is properly designed in such a manner that it can be broken off at its connecting end in the hole in the brush handle so that one can easily identify if a toothbrush has been used before.

DETAILED DESCRIPTION OF THE PREFERRED EMBODIMENT

Figure 1:
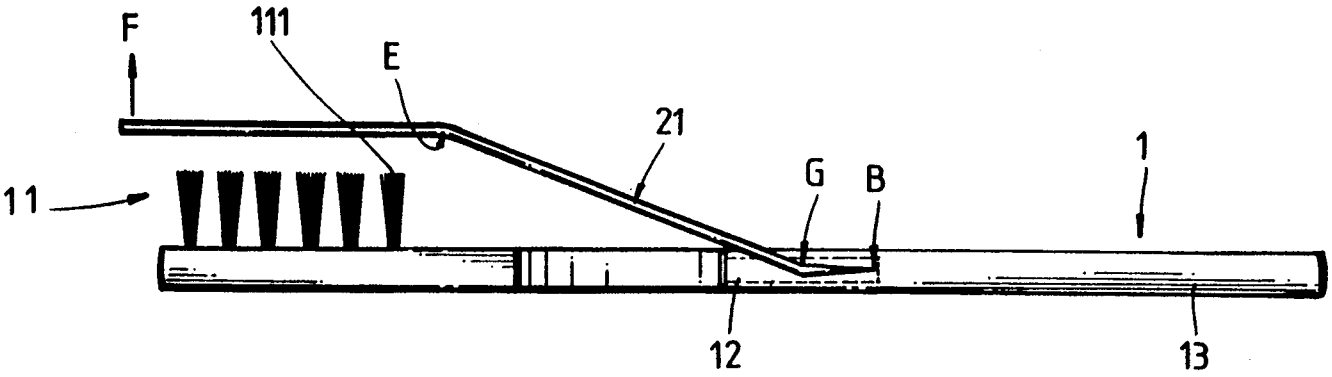
FIG. 1 is a side elevational view of a hygienic toothbrush embodying the present invention.
Figure 2:
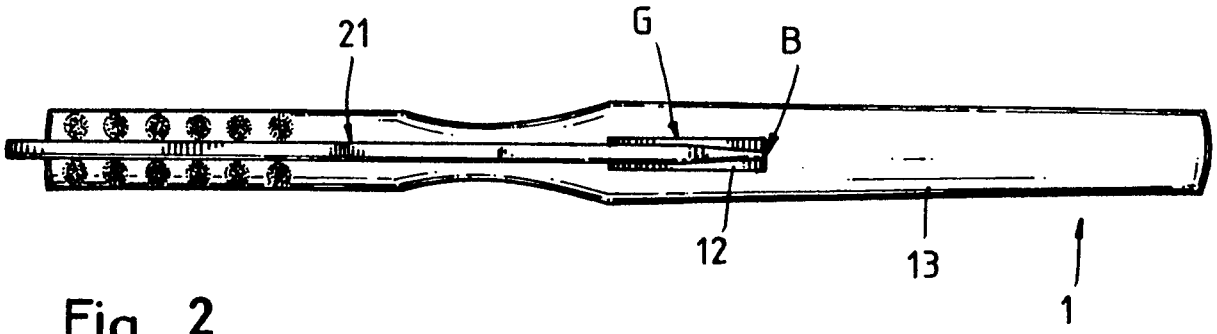
FIG. 2 is a top view of the hygienic toothbrush of FIG. 1.

Referring to the annexed drawings in greater detail, a toothbrush 1 in accordance with the present invention comprises a handle 13 incorporated with a brush head into which bundles of bristles 11 are fastened, wherein the handle 13 comprises a hole 12 from which an unitary protective strip 21 extends outward to project over the bundles of bristles 11. When in use, the protective strip 21 is bent upward (along the direction F as illustrated in the FIG. 1) to break off at the connection point B in the hole 12. Because the broken point B is inside the hole 12, the handle 13 does not do any hurt during teeth brushing process after the protecting strip 21 is removed.

Referring to FIG. 1 again, the protective strip 21 horizontally extends outward from its connection end B, which is unitarily incorporated with the inner back side wall portion of the hole 12, and turns obliquely upward at a first bent G, which is at a position inside the hole 12, and further turns horizontally forward over the bundles of bristles 11 of the brush head at a second bent E which is just at a position right above the top rear end 111 of the bundles of bristles 11. The contained angle at the first bent G as well as at the second bent E is over 120 degree. The width and thickness of the protective strip 21 are gradually reducing from the first bent G to the connecting point B so that the protective strip 21 can be conveniently broken off at the connecting point B.

I claim:

1. A disposable toothbrush comprising an elongated handle having opposite ends and an intermediate portion, said intermediate portion having a hole therein, a plurality of bristles secured to one end of the handle, said bristles having outer ends, an elongated strip of material integral with said handle and including a first end portion extending into the hole of and and therefore joined to said intermediate portion of the handle and adapted to be broken off from the handle, such strip extending from said first end portion thereof outwardly from said handle and including a second opposite end portion adjacent to and spaced from the outer ends of said bristles in a direction away from said one end of the handle so that it is necessary to break off the strip at the first end portion thereof and remove the strip in order to brush one's teeth and to indicate that the toothbrush has been used.

2. A disposable toothbrush as defined in claim 1 wherein said hole is defined by a plurality of walls including a back wall disposed closest to the end of the handle remote from said bristles, said first end portion being integral with said back wall.

3. A disposable toothbrush as defined in claim 2 wherein said strip includes a first length of strip extending from said first end portion of the strip and disposed within said hole, said strip including a second length of strip joined to said first length of strip by a first bent portion, said second length of strip extending obliquely away from said intermediate portion of the handle, said strip including a third length of strip joined to second length of strip by a second bent portion, said third length of strip being spaced from and extending substantially parallel to the outer ends of said bristle means.

4. A disposable toothbrush as defined in claim 3 wherein said first bent portion defines an included angle between said first length of strip and second length of strip, said second bent portion defining an included angle between said second length of strip and third length of strip, each of said included angles exceeding 120 degrees.

5. A disposable toothbrush as defined in claim 1 wherein the width and thickness of said strip gradually reduces from said first bent portion to the point at which said strip is joined to said intermediate portion so that said strip can be readily broken off at said point.

* * * * *